United States Patent [19]

Kunczynski

[11] 4,019,002

[45] Apr. 19, 1977

[54] POSITIVE CABLE DERAILMENT SENSING APPARATUS

[75] Inventor: Jan K. Kunczynski, Glenbrook, Nev.

[73] Assignee: Lift Engineering & Mfg., Inc., Carson City, Nev.

[22] Filed: June 18, 1975

[21] Appl. No.: 588,123

[52] U.S. Cl. ..... 200/61.18; 104/178

[51] Int. Cl.² ..... B61B 12/00

[58] Field of Search ..... 200/61.08, 61.13, 61.18, 200/61.41; 254/173 R–175.7; 104/173 R, 173 ST, 176, 178, 196; 242/147 R, 148

[56] References Cited

UNITED STATES PATENTS

| | | | |
|---|---|---|---|
| 472,178 | 4/1892 | Palmer | 254/175.3 |
| 528,775 | 11/1894 | Hogue | 254/175.3 |
| 2,630,085 | 3/1953 | Dusin et al. | 200/61.41 X |
| 2,689,890 | 9/1954 | Green | 200/61.13 |
| 3,822,369 | 6/1974 | Kunczynski | 200/61.08 |
| 3,845,323 | 10/1974 | Bellasio | 200/61.18 X |

*Primary Examiner*—James R. Scott
*Attorney, Agent, or Firm*—Warren, Chickering & Grunewald

[57] ABSTRACT

A positive cable derailment sensing apparatus and method for use with pulley means having a cable carried thereby to detect derailment of the cable from the pulley means is disclosed. The sensing apparatus includes a flexible tendon secured to a low inertia component of the pulley means, usually a pivotally mounted yoke carrying a pair of pulleys, and secured to spring biasing means to bias the low inertia component for movement upon derailment of the cable from the pulleys. The flexible tendon normally extends from the pulleys to a remote position which is protected or shielded from adverse environmental conditions. Sensing means is located at the remote protected location and formed to sense movement of the flexible tendon and stop the advancement of the cable over the pulley means upon derailment. A switch construction particularly well suited for sensing the derailment of either side of the looped cable of the type found on chairlifts or the like is also disclosed.

13 Claims, 7 Drawing Figures

POSITIVE CABLE DERAILMENT SENSING APPARATUS

BACKGROUND OF THE INVENION

There are numerous systems which employ a cable or flexible tendon which is carried on or driven by pulleys or sheaves. In most of these systems the problem of derailment of the cable from the sheaves is a serious and perplexing one. There are usually numerous safeguards in structures which are employed to attempt to prevent derailment, but these apparatus are not always foolproof.

One system in which derailment of a cable from its carrier sheaves is particularly troublesome and dangergous is in a chairlift of the type employed to transport skiers. Most chairlifts involve several thousand feet of cable stretched over periodically spaced pulleys mounted on towers. Some chairlifts are in excess of one mile in length, and constant supervision and observation of the movement of the chair-carrying cable over the pulleys along the entire length of the lift is normally not possible. Moreover, the method of attaching the chairs to the cable inherently prevents the use of cable derailment prevention structures on one side of the cable.

Occasionally, the cable for a chairlift may become derailed from one or more of the pulleys on which it is mounted. Usually the cable will be caught by a supporting structure so that danger to the passengers is minimized. If the chairlift is not stopped almost immediately after derailment, however, there is some danger that the derailed cable will further be pulled from the supporting structure or entangled in the same. If this should happen, there is a substantial hazard, particularly in steep mountainous terrain.

In order to increase the safety of chairlifts, attempts have been made to sense the derailment of the cables so that the lift can be immediately shut down and the cable replaced on the sheaves. One approach to this problem is to position a frangible electrically conductive element proximate the cable in the area in which the cable will move upon derailment. The cable will strike the frangible element upon derailment, and the frangible element can be used as a switch to automatically shut down the operation of the lift and indicate where the derailment has taken place. One such system is described in my prior U.S. Pat. No. 3,822,369 entitled "Frangible, Flexible Printed Circuit Sensor Fracturable by Derailed Cable," issued July 2, 1974. Another type of frangible cable sensing device is shown in U.S. Pat. No. 3,230,327.

While the use of frangible switches in connection with sensing cable derailment has generally been found to be quite satisfactory, there is always the theoretical possibility that a cable will derail in a manner causing the same to jump over the frangible switch. Accordingly, other approaches have been employed in attempt to sense cable derailments in chairlift systems.

In most chairlifts, each tower includes a series of sheaves or pulleys which are mounted in pairs to yokes, which in turn is mounted to a frame on the end of the tower arm. Each yoke is usually pivotally mounted to the frame, and accordingly, cable derailment systems have been employed in which one of the sheaves or pulleys on a yoke is formed from aluminum while the other is formed from cast iron. When the cable derails, the cast iron pulley outweighs the aluminum pulley and will be gravity biased downwardly and actuate a switch mounted proximate the yoke. This system, however, has been found to have some serious drawbacks. The chairlifts are often subjected to very adverse environmental conditions. Thus, it is not uncommon for a yoke to be frozen against pivotal movement, preventing actuations of the derailment sensing switch. Moreover, derailment sensing switches have been found to malfunction as a result of their exposure to vibrations on the pulley frame and the extreme adverse weather conditions. Another approach is based upon the pivotal mounting of the frame carrying the sets of pulleys and yokes to the end of the tower arm. A wire or tendon is connected at one end to the frame and at the other end to a tension spring which is secured to the tower cross arm. A sensor is mounted to the tower cross arm and senses movement of the tendon or wire. When the cable is derailed from the pulleys, the spring causes the frame to rotate about the end of the cross arm, and the resulting movement of the wire or tendon can be sensed to shut down the chairlift. This system has also been found to have certain defects. First, the moment of inertia of the frame carrying anywhere between four and ten or more pulleys is very substantial. Moreover, the moment arm employed in such devices does not provide the desired mechanical advantage. Accordingly, the high moment of enertial, poor mechanical advantage and icing can combine to produce a system which is unreliable or intolerably slow to react to a cable derailment. In addition, this system again exposes the derailment sensing switch to highly adverse operating conditions.

Accordingly, it is an object of the present invention to provide a positive cable derailment sensing apparatus and method which has improved reliability and safety in the sensing of derailment of a cable from pulley means.

Another object of the present invention is to provide a positive cable derailment sensing apparatus in which the sensing switch can be positioned in a remote, protected location so as to minimize the possibility of malfunctioning.

Another object of the present invention is to provide a positive cable derailment sensing apparatus in which a single switch can be used to monitor cable derailment on either side of a loop-type endless chairlift cable.

Still a further object of the present invention is to provide a positive cable derailment sensing apparatus which is fatigue and vibration resistant, is easy and inexpensive to manufacture, is easy to install, can be adapted to a wide variety of chairlift tower attitudes and configurations, and requires minimum maintenance.

The positive cable derailment sensing apparatus and method of the present invention has other objects and features of advantage, some of which will be set forth in more detail or will become apparent from the description hereinafter and the accompanying drawing.

SUMMARY OF THE INVENTION

The cable derailment sensing device of the present invention is formed for use with pulley means having a cable carroed thereby, the pulley means being movably mounted to a support arm. The sensing apparatus includes tendon means secured proximate an end thereof to the pulley means for movement therewith, spring biasing means operatively connected to the tendon means and formed to bias the pulley means to a moved position upon derailment of the cable therefrom, and sensing means connected to the tendon means and formed to sense the movement of the tendon means upon movement of the pulley means to the moved position. The improvement of the present invention in one aspect is comprised of the pulley means including a low inertia pivotally mounted element, usually in the form of a yoke carrying a pair of pulleys, and the tendon means being secured to the low inertia component at a position causing pivotal movement of the same under the spring biasing force upon derailment of the pulley. In another aspect of the present invention the improvement comprises positioning the sensing means remote of the pulley in a protected location and employing flexible tendon means which extend from the pulley to the sensing means, preferably through guide means. The flexible tendon is further preferably connected at one end to sense derailment from the lead pulley in a set of pulleys and at the other end to sense derailment in the trailing pulley of a set of pulleys. Moreover, switch means formed to sense derailment of either of two side-by-side cable sections is preferably employed.

DESCRIPTION OF THE PREFERRED EMBODIMENTS

Figure 1:
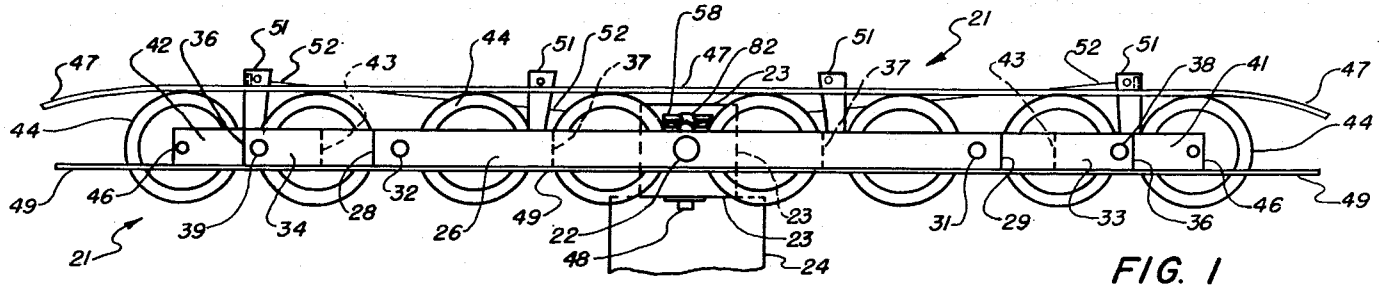
FIG. 1 is a fragmentary, side elevational view of a tower and pulley assembly having a cable derailment sensing apparatus constructed in accordance with the present invention incorporated therein.
Figure 2:
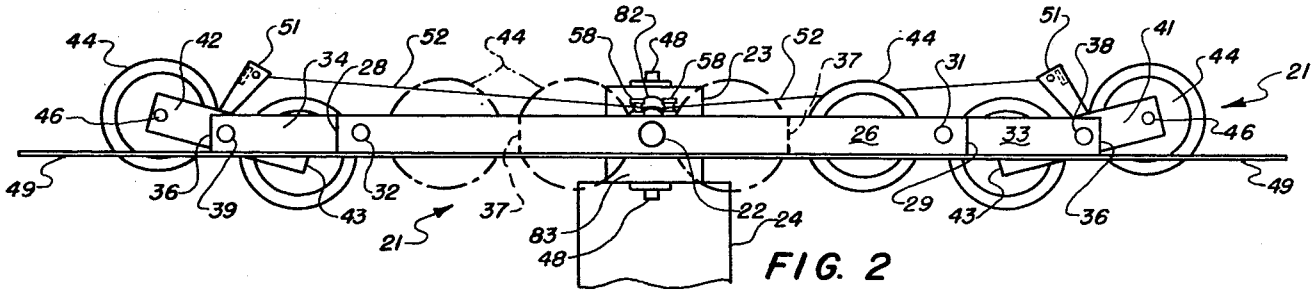
FIG. 2 is a fragmentary, side elevational view of the pulley assembly of FIG. 1 shown in a derailed condition.

Referring now to FIGS. 1 and 2, a typical chairlift tower is shown having a pulley means or assembly, generally designated 21, pivotally mounted to shaft 22 which extends outwardly from transverse cross arm 23. Cross arm 23 in turn is mounted to a vertically extending tower structure or post 24. Cross arm 23 normally extends transversely of post 24 in two directions with a second pulley assembly similar to the pulley assembly of FIGS. 1 and 2 being mounted to the opposite end of the cross arm.

Figure 3:
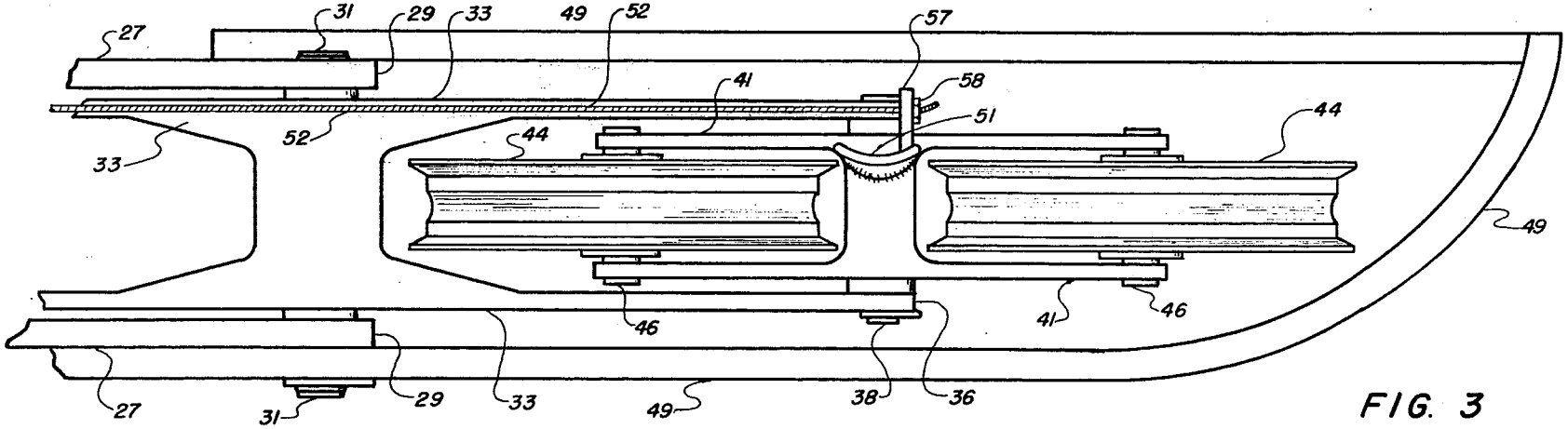
FIG. 3 is an enlarged, fragmentary, top plan view of an end of the pulley assembly of FIG. 1.

As will be understood, pulley menas or assembly 21 can take a number of different forms, but in the form illustrated, pulley assembly 21 includes a pair of side-by-side frame elements 26 and 27 (best seen in FIG. 3), which frame elements at ends 28 and 19. Pivotally mounted about shafts 31 and 32 are a first yoke 33 and a second yoke 34. Yokes 33 and 34 terminate at outer ends 36 and inner ends 37. Pivotally mounted about shafts 38 and 39 proximate outer ends 36 of the first and second yokes are a third yoke 41 and a fourth yoke 42. The inner ends of the third and fourth yokes terminate at 43. Also pivotally mounted to the first and second yokes 33 and 34 proximate inner ends 37 are a fifth and sixth yoke. The plurality of sheaves or pulleys 44 (in this case eight) in the pulley assembly shown are mounted by shafts 46 in balanced pairs to pivotally mounted yokes. This structure insures automatic adjustment of the sheaves to conform to and evenly support cable 47. Thus, the pairs of sheaves will rock on the yoke until both sheaves evenly support the weight on the cable, and the frame elements 26 and 27 will pivot about the shaft 22 until the entire assembly 21 reaches th optimum angle with respect to tower post 24 for even support of the cable. This floating sheave structure, which is well known in the art, tends to enhance cable tracking on the sheaves and reduce the likelihood of a cable derailment. To provide additional adjustment, it is also possible for shaft 22 to be angularly displaced by adjusting nuts 48 to vary the angular orientation of the entire assembly. The pulley assembly or means 21 further preferably includes a peripherally extending guard rail 49, which assists in deflecting objects from entry into the rotating pulleys or sheaves of the assembly.

In order to redue the possibility of derailment of cable 47 inwardly toward tower 24, each of the double-ended yokes is preferably provided with an upwardly extending cable catching arm 51. Arms 51 can be seen in FIG. 1 to extend above the nominal height of cable 47 as supported on the sheaves. Derailment of the cable outwardly of post 24 is more difficult to prevent since the chairlift hanger arms must pass along the outside of the sheaves and frame 26. Accordingly, cable derailment sensing apparatus is normally provided for such pulley assemblies.

Figure 5:
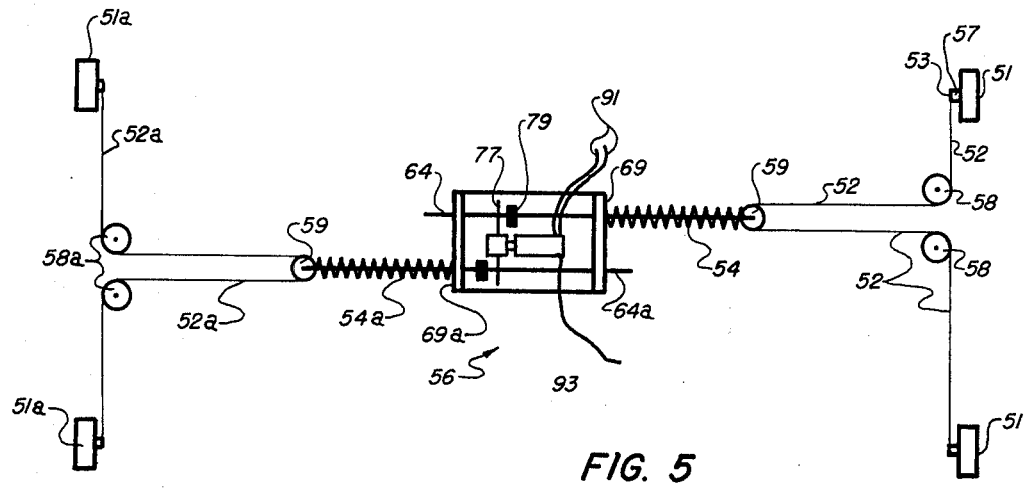
FIG. 5 is a schematic plan view of a positive cable derailment sensing apparatus constructed in accordance with the present invention.

The basic components of the sensing apparatus of the present invention can be seen by reference to FIG. 5 in which flexible tendon means 52 is shown connected at 53 proximate one end thereof to a portion of the pulley assembly 21. Also connected to flexible tendon means 52 is spring biasing means 54, preferably a tension spring. Finally, sensing means, generally designated 56, is operatively connected to cable 52 and formed to sense movement in cable 52 as a result of movement of part of the pulley assembly 21.

In the improved cable derailment sensing apparatus of the present invention, tendon means 52 is secured proximate an end thereof to a movable, relatively low inertia component of pulley assembly 21 at a position causing movement of the low inertia element under forces generated by spring biasing means 54 upon derailment of cable 47. In the cable assembly 21 illustrated in the drawing, tendon means 52 is secured to a laterally projecting plate or flange 57 by a fastener 58, with flange 57 being welded to the upper end of the cable catching elements 51 mounted to the third double-ended yoke 41 and the fourth double-ended yoke 42. Thus, the flexible tendon 52 is secured to apply a biasing force tending to rotate the yoke assemblies 41 and 42 by means of the cable catching elements 51 which act as lever arms. It will be noted that tendon 52 extends substantially perpendicular to lever arms 51 so that the mechanical advantage with respect to the rotational shafts 38 and 39 is high and can be readily increased merely by lengthening the cable catching elements 51 on the leading and trailing pairs of sheaves.

Thus, instead of attempting to rotate the entire assembly about shaft 22, in the cable derailment sensing apparatus of the present invention the spring biasing force of tension spring 54 is applied only to the relatively low inertial components which comprise the leading and trailing sets of sheaves. If cable 47 derails from the assembly, such derailment will not commence at the central four sheaves, but instead will either start at one end of the assembly or the other. Accordingly, one need only bias or rotate the end sets of sheaves to sense cable derailment. As best may be seen in FIG. 2, when cable is derailed, spring 54 will pull the end pairs of sheaves and yokes to the upwardly displaced position. Such angular displacement of the pulley sets causes cable 52 to move along the assembly 21 of sheaves and around guide pulleys 58 and inwardly of arm 23. This in turn allows the pulley 59 which is secured to tension spring 54 to move inwardly toward sensing means 56. The inward displacement of pulley 59 toward sensing means 56 causes the sensing means to sense the derailment and shut down the lift in a manner which will be described in more detail hereinafter. As will be appreciated, derailment of the cable from either or both of the trailing or leading pairs of sheaves will result in displacement of the yoke on which the sheaves are mounted and movement of the cable so as to actuate the sensing means and shut down the lift.

The advantage of the derailment sensing system of the present invention is that spring 54 can be constructed so as to provide only a relatively modest spring force, for example, 40 lbs. force, and the efficient mounting of the cable to the end of the cable catcher 51 and the low inertia of a single double-ended yoke causes the derailment system to be highly responsive and readily overcome any tendency for icing or the like. The use of a single tendon or wire 52 having its ends secured to the leading and trailing sets of sheaves and the spring biasing and movement sensing means operatively connected thereto intermediate such ends further provides a simple system for monitoring cable derailments at either end of the pulley assembly without having to attempt to spring bias the entire relatively high inertial assembly.

Figure 6:
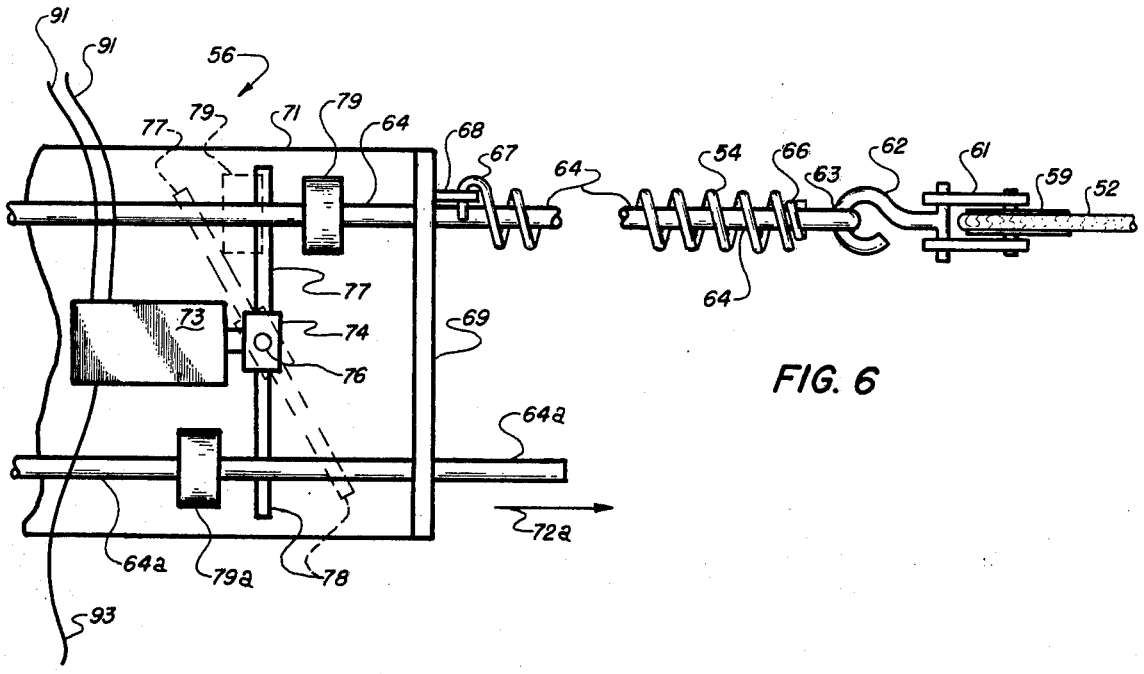
FIG. 6 is an enlarged, fragmentary, side elevational view of switch means suitable for use in the system of FIG. 5.

The details of construction of one form of tendon movement sensing means may best be seen by reference to FIG. 6. Tendon guide pulley 59 is mounted for rotation to a yoke 61 having a hook-like element 62 secured thereto. Mounted through the eye portion of the hook 62 is another hook or eye 63 having a rod-like body 64 which extends down the inside of spring 54. End 66 of spring 54 is secured to rod 64 by welding, braising or a fastener. The opposite end 67 is secured through link 68 to an upwardly projecting flange 69 on a plate 71 which is welded or otherwise secure rigidly to cross arm 23. Thus, the tension spring biasing force is applied to the cable by securing end 67 of the tension spring to plate 71, which in turn is secured to the cross arm, and securing the opposite end 66 to rod 64 which in turn is linked to pulley 59. It should also be noted that rod 64 passes freely through an oversized hole or opening in flange 69. As thus constructed, derailment of the cable will cause tendon 52 and pulley 59 to move in the direction of arrow 72 under the spring biasing force which in turn moves rod 64 in the same direction.

The movement of rod 64 is sensed by a switch 73 mounted to plate 71 and having a pivotal element 74 which rotates about axis 76. Extending laterally outwardly of element 74 are a pair of fork-like or bifurcated arms 77 and 78. The bifurcated arms 77 and 78span on either side of rod 64. In order 78 span cause pivoting of the bifurcated arms 77 and 78 switch actuating means 79 is mounted to rod 64. In operation, displacement inwardly of cable 52 upon pivoting of an end set of pulleys causes rod 64 to be displaced inwardly until swtich actuating element 79 moves in the direction of arrow 72 to change the condition of switch 73. This switching of the switch 73 can be used to shut down the lift.

In most chairlifts, the cable 47 is in the form of a continuous or endless loop which has its direction reversed at the top and the bottom of the chair by a horizontal or bull wheel. Thus, the same tower 24 and cross arm 23 are used to support a second sheave assembly (not shown) on the opposite side of the tower. As may be seen in FIG. 5, therefore, a second tendon means **52*a* connected to the trailing and leading sets of sheaves through cable catching elements 51*a*** and extending around pulleys 58*a* is provided. Tendon means **52*a* further extends around a movable pulley 59*a* which is secured to spring means 54*a*. Pulley means 59*a* is also secured to rod 64*a* which extends through flange 69*a* and has switch actuating element 79*a* mounted thereon. Rod 64*a* will be displaced in the directon of arrow 72*a* upon derailment of the cable on the return side of the tower. Such displacement will cause switching of the switch 73 to shut down the cable driving motor. Thus, the oppositely extending bifurcated arms 77 and 78 and the positioning of the switch actuating elements 79 and 79*a* will cause switching of the switch if either side of the tower experiences a derailment. The moved position of the arms 77 and 78 is shown in dotted lines on FIG. 6**.

Figure 4:
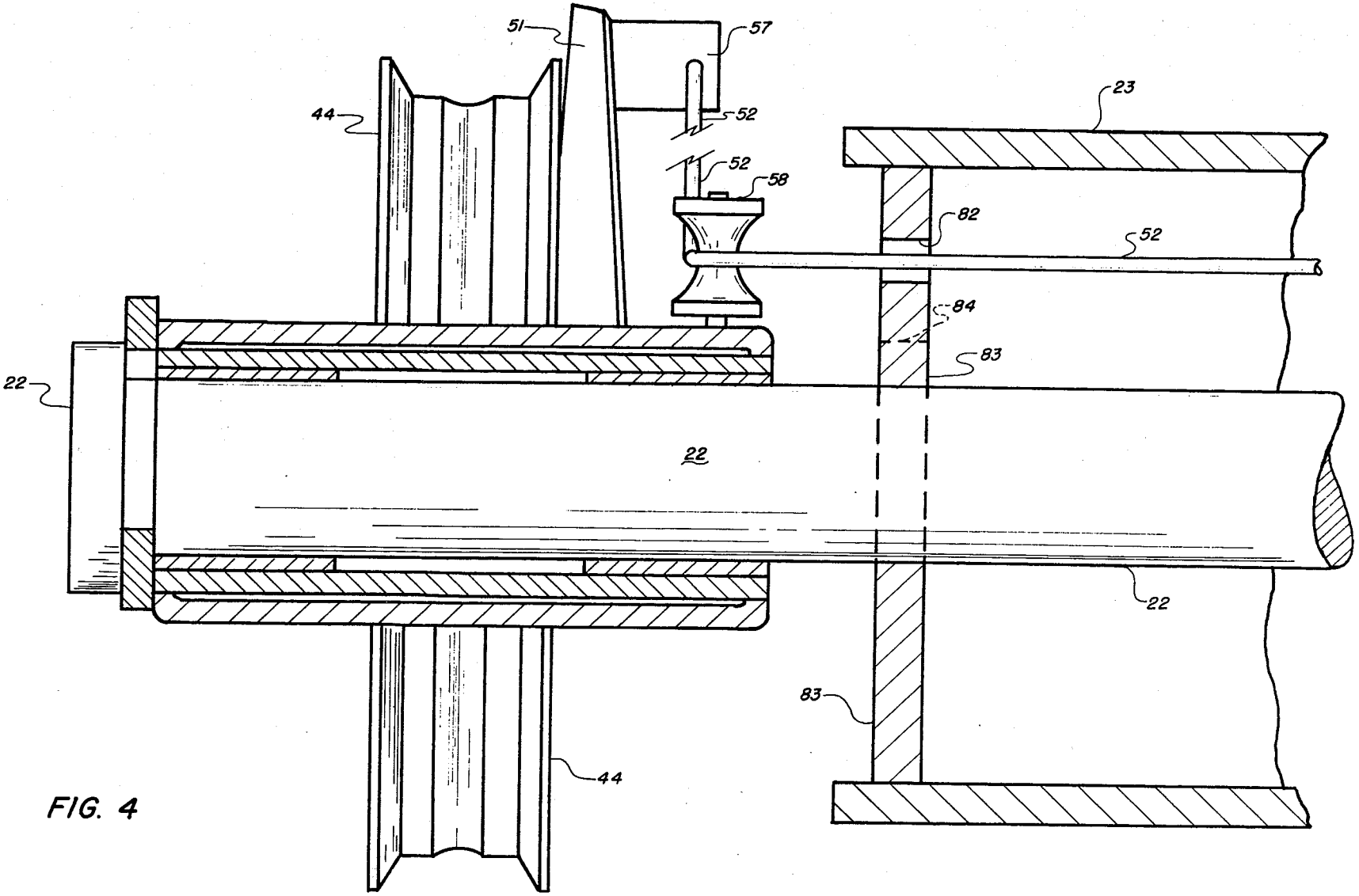
FIG. 4 is an enlarged, fragmentary, and elevational view, partially in cross-section, showing mounting of the pulley assembly of FIG. 1 to the cross arm.

It is an important feature of the present invention that the use of the spring biasing and a flexible cable to positively displace a low inertia element of the pulley means assembly be further employed to enable a positioning of the movement sensing switch in a protected location, usually relatively remote from the pulley assembly. Thus, in the preferred form of the invention, sensing switch 73 is located inside hollow cross arm 23, usually at about the central post or tower structure 24. This can be accomplished by passing flexible tendon 52 through an opening 82 in end wall 83 of the cross arm (best seen in FIG. 4). opening 82 is preferably slightly larger than cable 52 and preferably is formed as a curved moon-like slot, as indicated by the bottom end 84 of one side of the moon-like slot in FIG. 4. The radius of curvature of slot opening 82 has for its center the center of shaft 22 so that the entire pulley assembly can be rotated about shaft 22 with wire 52 merely being rotated within the moon-shaped slot 82 without hitting the sides thereof. This construction minimizes the opening into the interior of hollow arm 23 while accommodating a wide variety of angular changes between the sheave assembly 21 and post 24 to accommodate varying terrain.

When the switch is mounted inside cross arm 23 and directly over post 24, the switch is shielded against the build-up of moisture and deterioration from the sun's rays. Moreover, mounting of the switch directily over the vertical post 24 reduces th vibration to which the switch is subjected substantially over a mounting which would place the switch on the pully assembly or on the end of the cross arm. It is preferable to mount switch carrying plate to the interior of one of the vertical side walls of cross arm 23, rather than the bottom of the cross arm. This further insures that switch 73 is elevated above any moisture which might enter into the hollow cross arm. The mounting of plate 71 and the switch on the side wall of the cross arm is illustrated in FIG. 6. It should be noted that FIG. 5 shows plate 71 rotated by 90° for ease of schematic representation in the top plan view of FIG. 5. The mounting of FIG. 6 on a side wall of cross arm 23 is definitely preferred.

Figure 7:
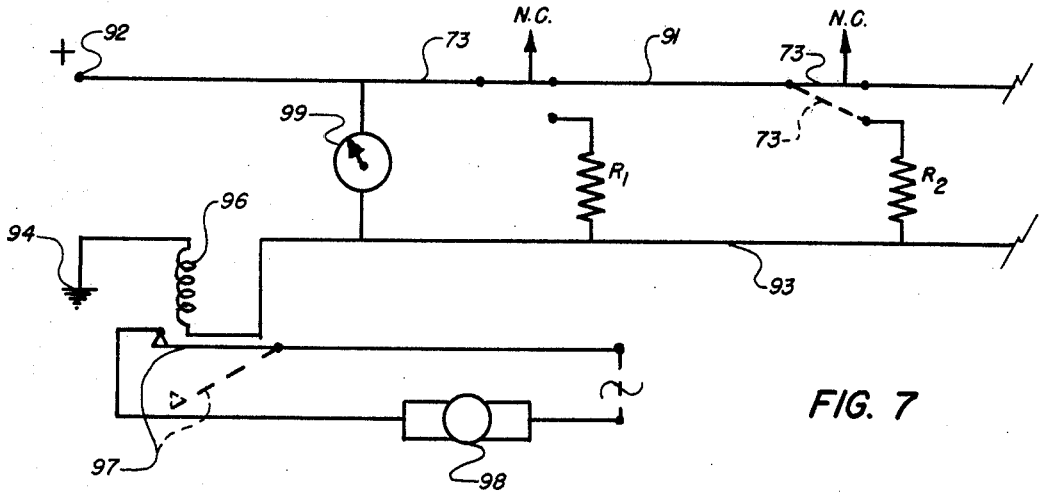
FIG. 7 is schematic representation of an electrical control circuit suitable for use with the cable derailment sensing apparatus of the present invention.

One manner in which the switch means 73 can be incorporated into an electrical system for controlling the movement of chairlift cable 47 is shown in FIG. 7. Switches 73 are preferably formed as normally closed (N.C.) switches connected in series by electrical conductors 91 from a positive source of direct current 92 through return conductor 93 to ground 94. Switches 73 are provided at each of the towers which have pulley assembly and conductors 91 and 93 run the length of the chairlift so as to connect the switches in series. When the cable is properly supported on all of the pulley assemblies, the switches will be in the normally closed position completing a circuit which will actuate solenoid 96 to close switch 97 so that a source of alternating current can be used to drive motor 98 which in turn drives cable 47. When one of switches 73 is displaced by a switch actuating element 79, the switch goes to an open position causing the circuit to be made through one of resistors $R_1$, $R_2$, $R_n$. Resistors $R_1$, $R_2$, $R_n$ are selected to have a resistance substantially greater than the resistance of conductors 91 and 93 and further to have a resistance which differes from each other so that each tower failure or derailment has a characteristic resistance which can be measured by resistance measuring meter 99. The flow of current through the resistors further causes the solenoid 96 to allow switch 97 to drop out immediately shutting down the cable driving motor 98. The operator can then look at meter 99 and immediately determine where the derailment has occurred. The derailment can be fixed and the switch 73 move to the normally closed position which will allow the solenoid to close switch 97. In addition to switch 97, the motor circuit 98 normally is provided with a manually operated switch so that one must have all of the switches in the direct current loop in the closed position to close solenoid actuated switch 97 and further to manually switch motor 98 to the "on" position driving the chairlift.

The positive cable derailment sensing apparatus of the present invention is adaptable to a variety of operating conditions and configurations. The length of the control wire or tendon 52 can be adjusted at the ends which are fastened to cable catching elements 51 so as to accommodate pulley assemblies having between four and twelve or more sheaves. It should also be noted that the biasing provided by spring means 54 causes the outermost pulleys 44 to be tilted upwardly upon a derailment. This further has the advantage of causing the outer pulleys to tend to follow or rise up with the cable. Thus, the derailment system can actually tend to reduce further the likelihood of derailment by causing the pulleys to raise and follow cable 47. If the angular rotation of yokes 41 and 42 is sufficient, the lift will be shut down, but the switch 73 can be biased for automatic return to the normally closed position so that if the cable drops back down on the pullyes, the lift tower circuit will be complete, and the motor can be restarted. Since the passage of chairs over the sheave assembly 21 does cause the double-ended yokes to tend to walk or oscillate slightly, the switch actuating elements 79 and **79*a* can be adjusted along rods 64 and 64*a* so that the normal movement of the yokes does not open switch 73. In this regard, it is preferable that elements 79 and 79*a*** are selectively movable along the length of the rods and yet are frictionally held in any predetermined place so that they can trigger the switch.

The derailment sensing apparatus of the present invention can be constructed of a variety of materials. It is preferable, however, to employ a flexible tendon or wire 52 which is a small diameter braided marine wire having a Teflon coating thereon. The Teflon coating reduces the chance of icing and insures that any ice which does build-up on the tendon will fracture and be brittle enabling movement of the tendon. Guide pulleys 58 and 59 are preferably formed of Teflon to reduce the friction in the system. The hook or eye portions 62 and 63 should either be welded together to enable pushing without slack or have a sufficiently tight fit that hook 62 can push rod 64 without lost motion. Any conventional normally closed switch can be employed as the sensing element so long as it is adaptable for mounting of arms 78 and 79 thereto. Since the total resistance of conductors 91 and 93 is likely to be on the order of less than 200 ohms, resistors $R_1$, $R_2$ and $R_n$ might conveniently be selected to start with $R_1$ equal to 1,000 ohms and each subsequent resistor being increased by 1,000 ohms.

What is claimed is:

1. In a cable derailment sensing apparatus for use with pulley means having a cable carried thereby, said pulley means being movably mounted to a support arm, said apparatus including tendon means secured proximate an end thereof to said pulley means for movement therewith, spring biasing means operatively connected to said tendon means and formed to bias said pulley means to a moved position upon derailment of said cable thereform, and sensing means connected to said tendon means and formed to sense the movement of said tendon means upon movement of said pulley means to said moved position, the improvement comprising:

said tendon means being secured to a low inertia movable component of said pulley means, said low inertia movable component being held in a first position during support of said cable on said pulley means and being movable to a displaced second position upon derailment of said cable from said pulley means independently of movement of said pulley means with respect to said support arm, said tendon means being secured to said low inertia movable component to apply a biasing force urging said low inertia movable component toward said displaced second position.

2. The cable derailment sensing apparatus as defined in claim 1 wherein, said low inertia movable component is formed as a doble-ended yoke carrying a rotatably mounted pulley proximate each end of said yoke, said yoke being pivotally mounted to the remainder of said pulley means, and said tendon means being secured to said yoke to cause pivoting of the same to said displaced second position.

3. The cable derailment sensing apparatus as defined in claim 2 wherein, said yoke is mounted at one end of said pulley means, and a second double-ended yoke having a pair of pulleys rotatably mounted thereto is mounted proximate a second end of said pulley means, and said tendon means is secured at a second end to said second yoke, and said spring biasing means and said sensing means are operatively connected to said tendon means intermediate the ends thereof.

4. The cable derailment sensing apparatus as defined in claim 1 wherein, said yoke is provided with a lever arm extending outwardly thereform, and said tendon means is secured to said lever arm, said lever arm and said tendon means being relatively orientated to substantially maximize the spring biasing force about the center of pivoting of said yoke.

5. The cable derailment sensing apparatus as defined in claim 2 wherein.

said spring biasing means is provided by a tension spring, a guide pulley is mounted to said tendon means and connected to said tension spring for application of the spring biasing force to said tendon means, and at least one of said tension spring and said guide pulley is provided with actuating means formed to actuate said sensing means.

6. The cable derailment sensing apparatus as defined in claim 5 wherein, said actuating means is formed as a rod extending inside said tension spring and therebeyond, and said actuating means includes a switch actuating element mounted to said rod beyond said tension spring.

7. The cable derailment sensing apparatus as defined in claim 6 wherein, said sensing means includes a switch formed with a movable arm extending from said switch to a position for engagement by said actuating element, and said actuating element is frictionally mounted to said rod and formed for selective positioning along the length of said rod to determine the travel of said rod before engagement of said arm by said actuating element.

8. In a cable derailment sensing apparatus for use with pulley means having a cable carried thereby, said pulley means being movably mounted to a support arm, said apparatus including tendon means secured proximate an end thereof to said pulley means for movement therewith, spring biasing means operatively connected to said tendon means and formed to bias said pulley means to a moved position upon derailment of said cable therefrom, and sensing means connected to said tendon means and formed to sense the movement of said tendon means, the improvement comprising:

said sensing means being positioned remotely of said pulley means in a protected locations shielded from adverse environmental conditions, and said tendon mans is a flexible tendon and extends from said pulley means to a position proximate said sensing means.

9. The cable derailment sensing apparatus as defined in claim 8 wherein, said support arm is hollow and formed with an opening therein enabling passage of said flexible tendon therethrough, said sensing means is positioned inside the hollow support arm at a position remote from said opening, and said spring biasing means is positioned proximate said sensing means.

10. The cable derailment sensing apparatus as defined in claim 9 wherein, said opening is formed to permit angular displacement of said pulley means with respect to said arm without interfering with the movement of said tendon through said opening.

11. The cable derailment sensing apparatus as defined in claim 9 wherein, said sensing means is mounted on a vertically extending inside wall of said hollow arm.

12. In a cable derailment sensing apparatus for use with a pair of proximate pulley means having cable sections carried thereby, said pulley means each being movably mounted to a support arm, said apparatus including a pair of tendon means each secured proximate an end thereof to said pair of pulley means for movement therewith, a pair of spring biasing means operatively connected to said pair of tendon means and formed to bias said pair of pulley means to a moved position upon derailment of said sections of cable therefrom, the improvement comprising:

a sensing means connected to said pair of tendon means and formed to sense the movement of both of said pair of tendon means, said sensing means including a switch having at least two switch arms extending outwardly thereof, said switch arms both being connected to said switch for operation of said switch upon displacement of either of said switch arms, and said switch arms being formed and positioned for displacement of the same by actuating means mounted for movement with said pair of tendon means.

13. The cable derailment sensing apparatus as defined in claim 12 wherein, said switch arms are bifurcated and extend on either side of a rod-like element connected for movement to each of said pair of tendon means, each said rod-like element having an actuating element mounted thereon.

* * * * *

UNITED STATES PATENT OFFICE

CERTIFICATE OF CORRECTION

PATENT NO. : 4,019,002

DATED : April 19, 1977

INVENTOR(S) : Jan K. Kunczynski

It is certified that error appears in the above-identified patent and that said Letters Patent are hereby corrected as shown below:

Column 1, line 5, correct "INVENION" to read ---INVENTION---;
line 58, after "in" insert ---an---;

Column 2, line 27, correct "enertial" to read ---inertia---;
line 63, correct "carroed" to read ---carried---;

Column 3, line 15, correct "extend" to read ---extends---;
line 60, correct "menas" to read ---means---;
line 64, after "elements" insert ---terminate---;

Column 4, line 11, correct "yoke" to read ---yokes---;
line 14, correct "th" to read ---the---;
line 26, correct "redue" to read ---reduce---;

Column 5, line 5, correct "inertial" to read ---inertia---;
line 12, after "cable" insert ---47---;
line 44, correct "inertial" to read ---inertia---;
line 50, delete "the";

Column 6, line 3, correct "78span" (first occurrence) to read ---78 span---; and
line 3, delete "78 span" (second occurrence) and insert therefor ---to---;
line 64, correct "th" to read ---the---;
line 66, correct "pully" to read ---pulley---;

Column 7, line 31, correct "differes" to read ---differs---;
line 65, correct "pullyes" to read ---pulleys---;

UNITED STATES PATENT OFFICE

CERTIFICATE OF CORRECTION

PATENT NO. : 4,019,002

DATED : April 19, 1977

INVENTOR(S) : Jan K. Kunczynski (Page 2 of 2)

It is certified that error appears in the above-identified patent and that said Letters Patent are hereby corrected as shown below:

Column 8, line 38, (in Claim 1) correct "thereform" to read ---therefrom---;
line 58, (in Claim 2) correct "doble-ended" to read ---double-ended---;

Column 9, line 8, (in Claim 4) correct "claim 1" to read ---claim 2---;
line 12, (in Claim 4) correct "orientated" to read ---oriented---;
line 17, (in Claim 5) after "wherein" change the period to a comma;

Column 10, line 2, (in Claim 8) correct "locations" to read ---location---;
line 4, (in Claim 8) correct "mans" to read ---means---; and
line 24, (in Claim 11) after "inside" insert ---, side---.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*